US005245708A

United States Patent [19]

Campelia et al.

[11] Patent Number: 5,245,708

[45] Date of Patent: Sep. 21, 1993

[54] NECK APPAREL RESTRAINING DEVICE

[75] Inventors: Bruce Campelia, Sudbury; Clarice Campelia, So. Dennis; Darlene Robertson, Carlisle, all of Mass.

[73] Assignee: Capriccio, Carlisle, Mass.

[21] Appl. No.: 6,690

[22] Filed: Jan. 21, 1993

Related U.S. Application Data

[63] Continuation of Ser. No. 784,389, Oct. 29, 1991, abandoned.

[51] Int. Cl.[5] ..... A41D 25/00

[52] U.S. Cl. ..... 2/145; 24/49 R; 24/49 CF; 24/56

[58] Field of Search ..... 2/144, 145, 146; 24/49 R, 49 CF, 49 KC, 49 C, 50, 56, 57, 58

[56] References Cited

U.S. PATENT DOCUMENTS

| | | | |
|---|---|---|---|
| 1,048,393 | 12/1912 | Dewey . | |
| 1,291,090 | 1/1919 | Nuzum . | |
| 1,434,797 | 11/1922 | Shannon . | |
| 1,751,963 | 3/1930 | Weinschreider . | |
| 2,006,427 | 7/1935 | Wolfson | 2/145 |
| 2,029,597 | 2/1936 | Thomas . | |
| 2,652,569 | 9/1953 | Confino | 2/145 |
| 2,746,055 | 5/1956 | Gleason | 2/145 |
| 2,749,553 | 6/1956 | Miller . | |
| 3,439,360 | 4/1969 | Grubman | 2/155 |
| 3,453,696 | 7/1969 | Mates . | |
| 3,529,327 | 9/1970 | Missakian . | |
| 3,827,108 | 8/1974 | Jewett | 24/49 CF |
| 4,554,710 | 11/1985 | Grant | 24/49 CF |
| 4,827,576 | 5/1989 | Prince, Jr. | 24/49 CF |
| 4,835,821 | 6/1989 | Durante | 24/49 CF |
| 4,920,579 | 5/1990 | Swain | 2/145 |
| 4,972,523 | 11/1990 | Begg | 2/137 |
| 5,095,546 | 3/1992 | Jones | 2/144 X |
| 5,109,547 | 5/1992 | Abdallah | 2/144 X |

FOREIGN PATENT DOCUMENTS

| | | | |
|---|---|---|---|
| 158526 | 8/1954 | Australia | 2/145 |
| 1777649 | 4/1959 | France | 2/145 |

*Primary Examiner*—Glifford D. Crowder
*Assistant Examiner*—Jeanette Chapman
*Attorney, Agent, or Firm*—Daniel J. Borque; Anthony M. Davis; Michael J. Bujold

[57] ABSTRACT

A device restrains unwanted movement of neck apparel worn by a wearer along the front portion of a shirt having uniformly spaced fastening buttons. The restraining device is disposed vertically parallel to and proximate an unrestrained portion of the neck apparel. The restraining device slidably engages with a transversely arranged neck apparel member disposed on the unrestrained portion of the neck apparel. The device includes a soft pliable member having first and second elongated buttonhole openings proximate first and second ends of the member. The longitudinal centers of the first and second elongated buttonhole openings are separated a predetermined distance for releasably engaging with first and second uniformly spaced fastening buttons on the front of the shirt of a wearer. The restraining device permits essential vertical movement of the neck apparel along the restraining device, while generally restraining all other movement.

12 Claims, 3 Drawing Sheets

NECK APPAREL RESTRAINING DEVICE

This application is a continuation of application Ser. No. 07/784,389, filed Oct. 29, 1991now abandoned.

FIELD OF THE INVENTION

This invention relates to apparel and more particularly, to a device for restraining unwanted movement of neck apparel such as a necktie or scarf.

BACKGROUND OF THE INVENTION

Neckties have traditionally been a prominent part of men's apparel. Recent trends also disclose an increase in women who wear neck apparel such as scarfs or even neckties. Given the prominence of neck apparel, it is important to keep the neck apparel neat, clean, and in place in its proper position which is vertically against the front of the shirt or blouse of the wearer.

Unfortunately however, the traditional knotted necktie or neck scarf includes at least one unrestrained end opposite the neck of the wearer. This unrestrained end is typically very difficult to keep in place. This unrestrained portion receives the majority of occurrences of soiled or out of place neck apparel.

Several prior art attempts at providing neck apparel restraints have met with limited success for a number of reasons. For example, tie pins permanently damage a necktie and become inoperative whenever either the clasp or pin portion become lost or separated. Tie bars similarly permanently wrinkle the necktie. Further, tie pins or bars are not an accepted part of women's jewelry. Most importantly, both tie pins and tie bars restrict the vertical movement of the neck apparel on the wearer, often causing the neck apparel to pull down from the neck of the wearer or causing a large bow in the upper portion of the neck apparel between the neck of the wearer and the tie pin or bar.

Other prior art devices for restraining neck apparel include devices which are permanently attached to the necktie, or devices which are stiff and not resilient. These prior art devices have accordingly not gained tremendous success because in the first instance, one restraining device must be provided for each necktie in the wearer's wardrobe, while in the second instance, unpliable or stiff restraining devices are very uncomfortable for the wearer when he or she is seated or otherwise moves, and do not allow the tie to conform to the wearer's position and the front of the wearer's body. Most importantly, many prior art necktie or neck apparel restraining devices do not allow for unlimited placement and attachment of the device to the shirt or blouse of a wearer when a transversely arranged necktie crosspiece, scarf clasp, or other similar member falls at or near a shirt button. Further, many prior art necktie fastening or restraining devices are not suitable and may not be used with other types of neck apparel such as scarfs worn by many women today. Additionally, many prior art devices must be color or fashion coordinated to the clothing of the wearer.

Accordingly, what is needed is a soft, resilient neck apparel restraining device which is not permanently affixed to a necktie, scarf, or other similar neck apparel and which can be easily and comfortably worn by any wearer and which is generally hidden from view when being worn.

SUMMARY OF THE INVENTION

This invention features a novel neck apparel restraining device which may be worn in conjunction with any necktie, scarf, or similar neck apparel, and which allows essential freedom of vertical movement of the neck apparel while restraining unwanted movement in other directions. The restraining device additionally conforms to the wearer thereby providing a device which may be comfortably and invisibly worn. Further, the predetermined spacing between the elongated buttonhole openings which engage with uniformly spaced shirt fastening buttons allows the device to be used when the necktie or neck apparel transverse member with which the restraining device engages is located at or near a shirt fastening button.

Accordingly, this invention provides a restraining device for restraining movement of neck apparel worn along the front portion of a shirt having uniformly shaped fastening buttons and includes a single soft, pliable member. The soft, pliable member is made from a cloth-like material including broadloom cloth and silk or other material of similar qualities such as leather. The soft pliable member includes first and second ends.

The restraining device is disposed vertically, parallel to the neck apparel worn by the wearer and is located proximate an unrestrained portion of the neck apparel. The restraining device slidably engages with a transversely arranged neck apparel member disposed on an unrestrained portion of the neck apparel.

Further, the soft pliable member includes first and second elongated buttonhole openings proximate the first and second end of the member. The longitudinal centers of the first and second elongated buttonhole openings are separated a predetermined distance which, in one embodiment, approximately corresponds to the distance between the uniformly spaced shirt fastening buttons. The soft pliable member releasably engages with the first and second uniformly spaced fastening buttons on the front of the shirt of a wearer and permits limited vertical movement of the transversely arranged neck apparel member and the attached unrestrained portion of the neck apparel while generally restraining all other movement.

In a preferred embodiment, the predetermined distance which separates the longitudinal centers of the first and second elongated buttonhole openings on the soft, pliable member is greater than the distance between the uniformly spaced shirt fastening buttons.

DESCRIPTION OF THE DRAWINGS

These, and other features and advantages of the present invention will be better understood by reading the following detailed description taken together with the drawings wherein.

DETAILED DESCRIPTION OF THE INVENTION

Figure 1:
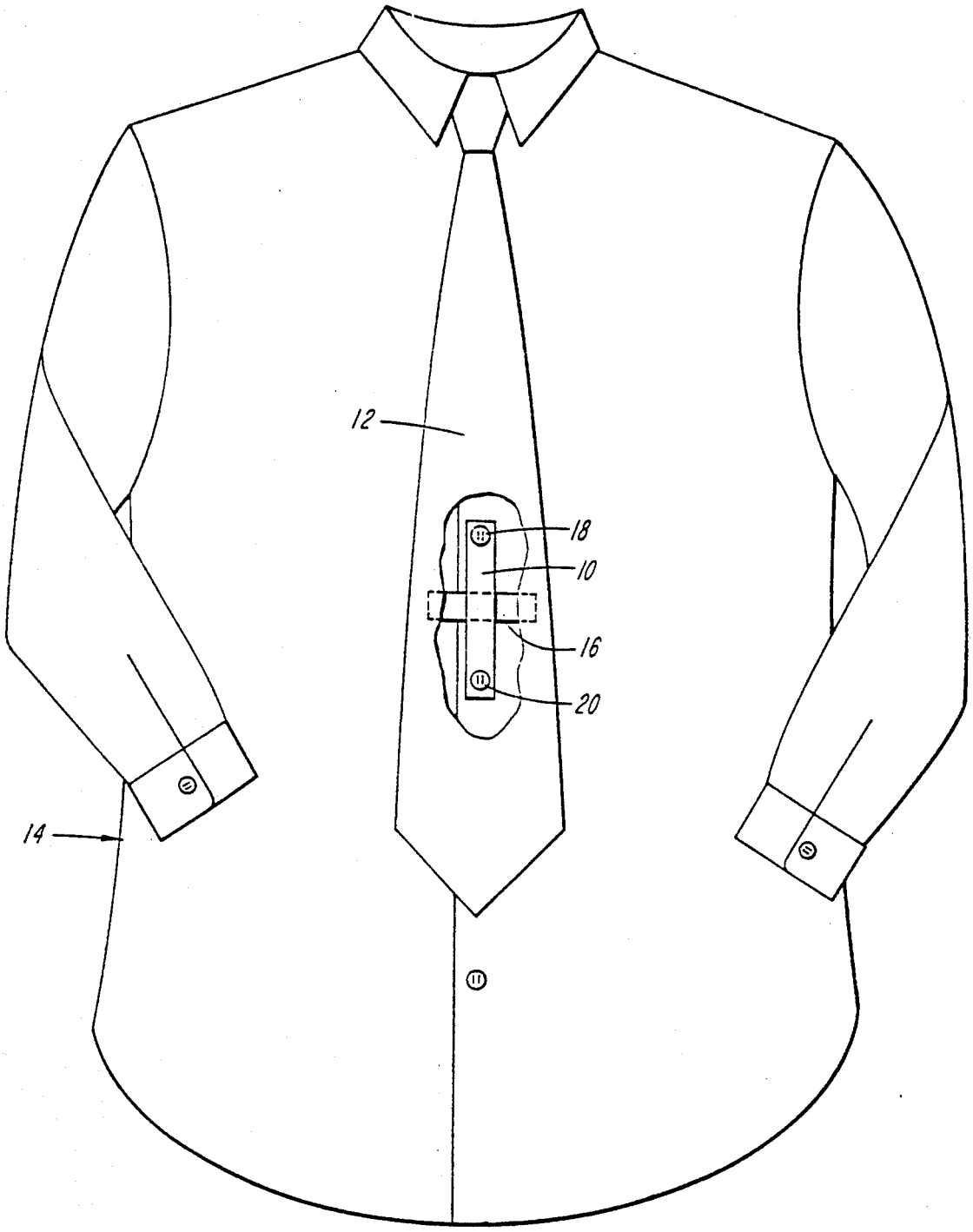
FIG. 1 is a front view of the shirt of a wearer with a cut-away showing the neck apparel restraining device according to the present invention.

The neck apparel restraining device 10, FIG. 1, according to the present invention is adapted for use with any type of apparel such as necktie 12 whose proper position is vertical, against the front of a shirt or blouse 14 of a wearer (not shown). The neck apparel restraining device 10 of the present invention slidably engages with a transverse member 16 associated with the apparel. In the case of a necktie, for example, the transverse member comprises a label or similar cloth member which is generally sewn or otherwise fastened to the wider, front portion of the necktie and through which the tail or narrow portion of the necktie typically is passed.

Tie restraining device lo is typically comprised of a soft, pliable material such as a broadloom cloth, silk or leather. The soft pliable material includes first and second elongated buttonholes proximate the ends of the member for engaging with first and second uniformly spaced shirt fastening buttons 18 and 20.

Figure 2:
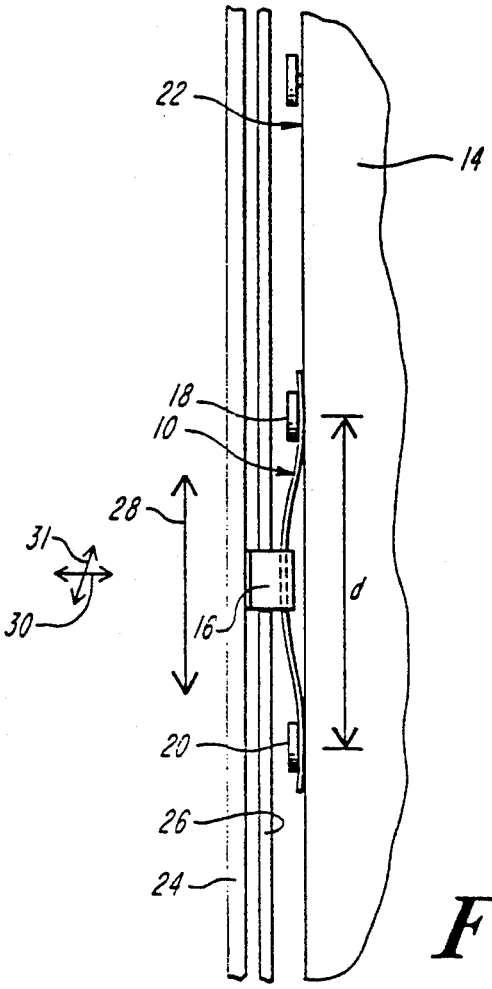
FIG. 2 is a cross-sectional view of a portion of neck apparel being worn by a wearer showing the restraining device of the present invention.

As shown in greater detail in the cross-sectional drawing of FIG. 2, the neck apparel restraining device 10 is disposed vertically, generally parallel to necktie 12 and the front 22 of the shirt 14 of the wearer. The restraining device 10 slidably engages with a transverse member 16 which is attached to the front portion 24 of necktie 12. The wearer typically also inserts the tail or back portion 26 of the necktie through the transverse member 16.

As previously stated, the apparel restraining device 10 includes two elongated slots which serve as buttonholes proximate the ends of the device, for releasably engaging the restraining device with first and second uniformly spaced shirt fastening buttons 18 and 20. The uniformly spaced shirt fastening buttons are spaced apart a predetermined distance indicated generally by arrow "d". In one embodiment, the distance between the longitudinal centers of the elongated slots or buttonholes of the restraining device 10 is generally equal to the predetermined distance "d" between the uniformly spaced shirt fastening buttons.

Slidably engaging the apparel restraining device 10 with the necktie transverse member 16 allows the necktie a fairly extensive amount of freedom in the vertical direction as indicated generally by arrow 28 while severely limiting the amount of movement of the necktie in a direction transverse to the front of the wearer as indicated generally by arrows 30 and 31. Providing for a generous amount of vertical movement of the necktie allows the necktie or other neck apparel to slide up and down along the length of the apparel restraining device 10 when movements of the wearer so demand, enhancing the appearance of the neck apparel and providing a comfortable fit to the wearer.

For example, when the wearer is seated, the transverse member of the necktie may slide downward toward shirt fastening button 20 thus preventing bunching up or curling of the necktie nearer the neck of the wearer. Similarly, when the wearer is standing, transverse member 16 may slide upwardly toward shirt fastening button 18 thereby preventing the necktie from being pulled away from the neck of the wearer. Thus, the necktie or other apparel of the wearer remains flat along the front of the shirt or blouse of the wearer without any unsightly buckling and without discomfort to the wearers.

Figure 3:
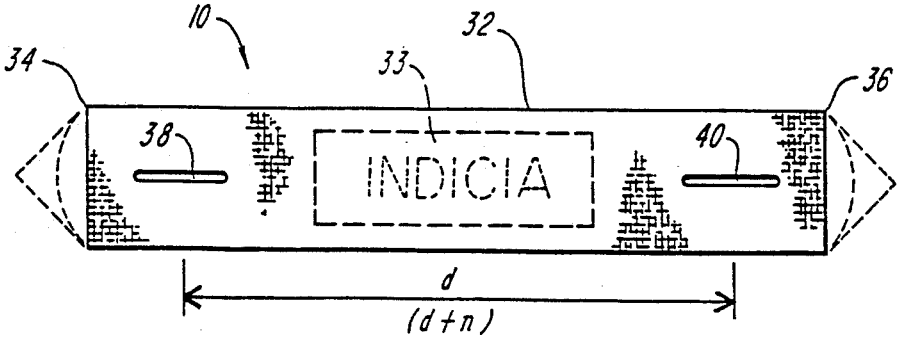
FIG. 3 is a schematic illustration of the neck apparel restraining device of the present invention.

As illustrated in FIG. 3, the neck apparel restraining device 10 includes in a finished form, a single length of a soft pliable member 32 which comprises a cloth-like material including a broadloom cloth, silk or similar material such as leather. The soft pliable member includes first and second ends 34,36 which may have a square, triangular, or radially curved shape. The restraining device further includes first and second elongated buttonholes 38 and 4 proximate the two ends of the soft pliable member 32. As previously stated, in one embodiment of the present invention, the distance between the longitudinal center of the first and second buttonholes 38 and 40 is generally equal to "d" which is approximately equal to the distance between the uniformly spaced shirt fastening buttons. In a preferred embodiment, however, the distance between the longitudinal centers of the first and second elongated openings 38 and 40 is equal to "d+n", where "n" is in the range of 0.25" to 0.75".

In another embodiment, the restraining device 10 includes written or printed indicia such as a label, monogram, or embroidery 33 which allows the restraining device to be personalized for the wearer or marked with a distributor's or clothing store's private label.

Figure 4:
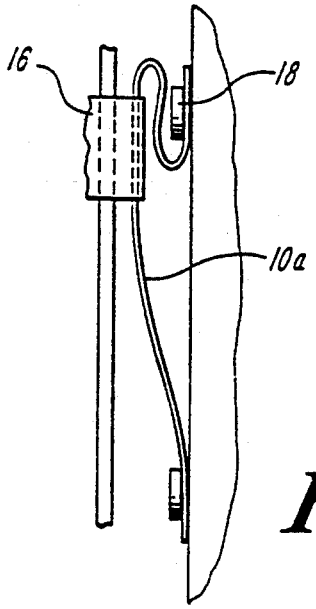
FIG. 4 is a cross-sectional view of the neck apparel restraining device of the present invention in use with a neck apparel transverse member located at or near the button of a wearer's apparel.

The advantages of an apparel restraining device according to the present invention which has a distance between the longitudinal centers of the elongated openings greater than the predetermined distance between the shirt fastening buttons is illustrated in FIG. 4. In the prior art, when a transverse member 16 was disposed proximate or adjacent a shirt fastening button 18, the stiff non-resilient tie fasteners could not be inserted through the transverse element, and the wearer was forced to forego wearing the device or to re-tie the necktie knot, often ending up with the transverse member at the same location as before the knot was re-tied.

However, when wearing the apparel restraining device 10*a* of the present invention which includes a distance between the longitudinal centers of the elongated openings which is greater than the distance between the shirt fastening buttons, the wearer very simply and quickly passes the restraining device 10*a* through transverse member 16 despite its location at or near shirt fastening button 18 by virtue of both the pliableness of the member and the increased distance between the elongated openings which engage with the shirt buttons.

Figure 5:
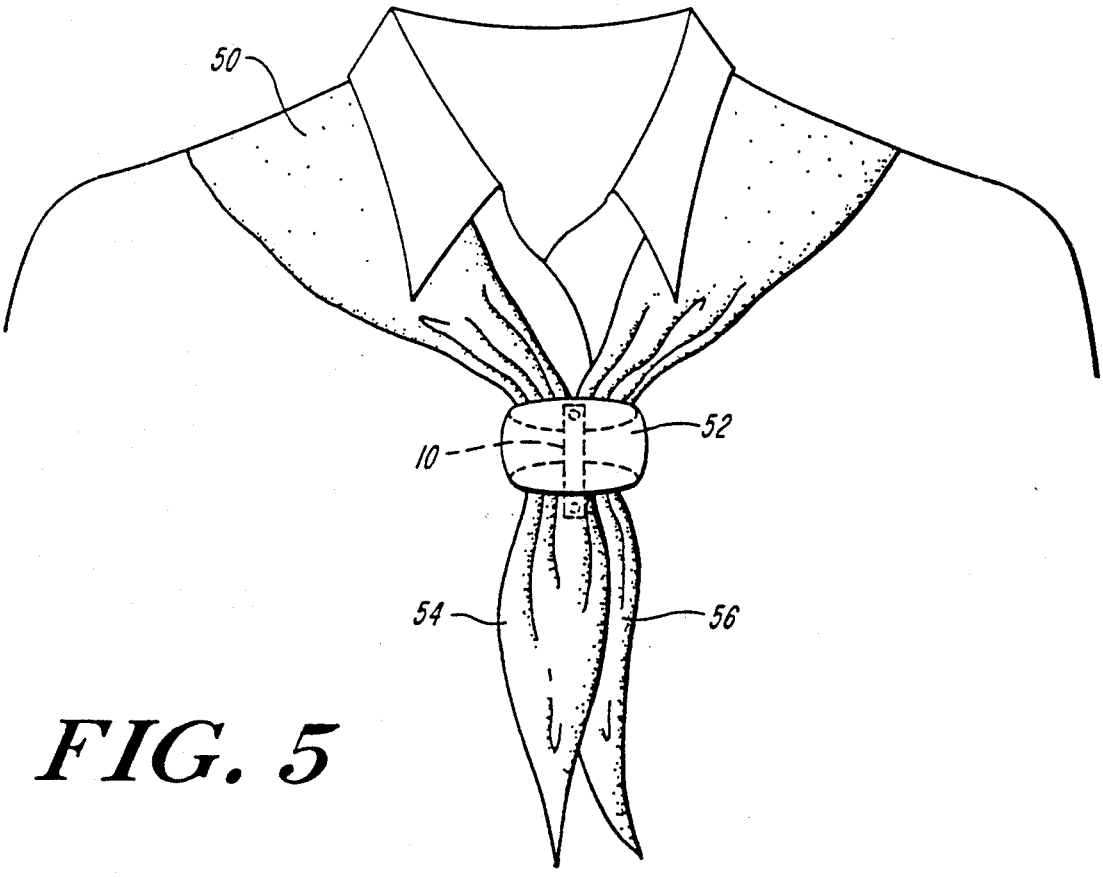
FIG. 5 is a front view of a scarf being worn by a wearer and including a cut-away showing the neck apparel restraining device of the present invention.

Use of the apparel restraining device of the present invention is not limited to neckties nor to apparel with permanently attached transverse members. For example, as illustrated in FIG. 5, the wearer of a scarf 50 or other similar apparel employing a scarf clip 52 or other similar transverse device to hold the two ends 54 and 56 of the scarf in place may utilize the restraining device of the present invention by inserting the device through the scarf clip 52 and fastening the restraining device of the present invention to first and second fastening buttons on the front of the blouse or shirt of the wearer.

Modifications and substitutions by one of ordinary skill in the art are considered to be within the scope of the present invention which is not to be limited except by the claims which follow.

We claim:

1. A method for using a neck apparel restraining device with any one of a plurality of neck apparel items, for restraining movement of the neck apparel worn by a wearer along the front portion of a shirt having at least first and second uniformly spaced fastening buttons, said restraining device disposed vertically, parallel to said neck apparel and proximate an unrestrained portion of said neck apparel, said restraining device slidably engaging with and interposed behind a transversely arranged neck apparel member disposed on said unrestrained portion of said neck apparel, said restraining device comprising, a single, unitary, soft pliable member comprising a length of cloth-like material having first and second ends, said single, unitary, soft pliable member not attached to said neck apparel worn by said wearer, and, said single, unitary, soft pliable member including first and second elongated buttonhole openings proximate said first and second ends respectively, the longitudinal centers of said first and second elongated buttonhole openings separated a predetermined distance, said predetermined distance generally corresponding to at least a distance between said uniformly spaced shirt fastening buttons, for releasably engaging with first and second uniformly spaced fastening buttons on the front of the shirt of the wearer which are disposed proximate said transversely arranged neck apparel member, said method comprising the steps of:

engaging one of said first and second elongated buttonhole openings proximate one of said first and second ends of said restraining device with one of said first and second uniformly spaced shirt fastening buttons located proximate said transversely arranged neck apparel member;

interposing said restraining device behind said transversely arranged neck apparel member, between said transversely arranged neck apparel member and said unrestrained portion of said neck apparel; and engaging the other of said first and second elongated buttonhole openings proximate the other of said first and second ends of said restraining device, with the other of said first and second uniformly spaced shirt fastening buttons disposed proximate restraining device vertically, parallel to said front portion of said shirt of said wearer, and slidably engaged behind said transversely arranged neck apparel member, for permitting vertical movement of the transversely arranged neck apparel member and the unrestrained portion of said neck apparel along said vertically disposed restraining device, and generally restraining all other movement.

2. The method of claim 1 wherein said soft pliable member is made from cloth.

3. The method of claim 1 wherein said soft pliable member is made from leather.

4. The method of claim 1 wherein said soft pliable member is made from silk.

5. The method of claim 1 wherein said predetermined distance between the longitudinal centers of said first and second elongated buttonhole openings is approximately one-half inch longer than a distance between said uniformly spaced shirt fastening buttons.

6. The method of claim 1 wherein said neck apparel includes a necktie.

7. The method of claim 1 wherein said neck apparel includes a neck scarf.

8. The method of claim 1 wherein said restraining device further includes indicia.

9. The method of claim 8 wherein said indicia includes a label.

10. The method of claim 8 wherein said indicia includes a monogram.

11. The method of claim 8 wherein said indicia includes embroidery.

12. The method of claim 1 wherein said predetermined distance separating the longitudinal centers of said first and second elongated buttonhole openings of said single, unitary, soft pliable member, is greater than the distance between each of said uniformly spaced shirt fastening buttons.

* * * * *